US005166649A

United States Patent [19]

Aizawa et al.

[11] Patent Number: 5,166,649

[45] Date of Patent: Nov. 24, 1992

[54] DIELECTRIC FILTERS WITH A SINGLE THROUGH-HOLE

[75] Inventors: Kimio Aizawa, Ikoma; Takashi Fujino, Izumi; Toshio Ishizaki, Kobe, all of Japan

[73] Assignee: Matsushita Electric Industrial Co. Ltd., Osaka, Japan

[21] Appl. No.: 730,671

[22] Filed: Jul. 16, 1991

[30] Foreign Application Priority Data

Jul. 16, 1990 [JP] Japan ..... 2-189029

[51] Int. Cl.[5] ..... H01P 1/20; H01P 1/202

[52] U.S. Cl. ..... 333/202; 333/206

[58] Field of Search ..... 333/202, 203, 206, 207, 333/219, 222, 223

[56] References Cited

FOREIGN PATENT DOCUMENTS 0156903 7/1986 Japan ..... 333/206

0018801 1/1987 Japan ..... 333/202

*Primary Examiner*—Eugene R. Laroche

*Assistant Examiner*—Seung Ham

*Attorney, Agent, or Firm*—Ratner & Prestia

[57] ABSTRACT

This invention offers a compact and high performance dielectric filter consisting of a quarter wavelength dielectric body provided with a through-hole between the upper and lower surfaces of the dielectric body, electrodes deposited on external and lower surfaces of the dielectric body, and at least two independent electrodes provided on an internal surface of the through-hole, extending to the upper and lower surfaces of the dielectric body. With this dielectric filter construction, the through-hole performs the role of constructing plural quarter wavelength resonators and performs, at the same time, the role of adjusting the coupling between the plural resonators, thus yielding a compact dielectric filter of simple construction.

5 Claims, 2 Drawing Sheets

DIELECTRIC FILTERS WITH A SINGLE THROUGH-HOLE

PURPOSE OF THE INVENTION

This invention relates to dielectric filters employed in high-frequency communication equipment, and offers compact dielectric filters of simple construction.

BACKGROUND OF THE INVENTION

A conventional dielectric filter is now explained by referring to FIG. 4 which shows a pillar-shaped quarter-wavelength dielectric body 1 provided with a plurality of through-holes (in this case, three holes) 2, 3 and 4, respectively, which connect the upper and lower surfaces of pillar-shaped dielectric body 1, electrodes 5 provided on outer and lower surfaces of dielectric body 1, and pillar-shaped insulators 8 and 9 in which lead wires 6 and 7 are incorporated integrally and inserted in holes 2 and 4.

With the above-explained construction of a conventional resonator, two quarter-wavelength coaxial resonators are constructed of segments including holes 2 and 4 which are regarded as inner conductors, and hole 3 which adjusts the magnetic field coupling between the two coaxial resonators. Lead wires 6 and 7 are capacitively coupled to electrodes coated on the internal surfaces of holes 2 and 4 through insulators 8 and 9, and lead electric signals in and out.

According to the construction of the filter of FIG. 4, three through-holes 2, 3, and 4 have to be provided within said dielectric body 1, and this means that $(2n-1)$ holes have to be provided on the dielectric body in order to construct a filter having n-stages of resonators. However, this construction work requires a highly complicated and precise press molding of dielectric ceramics to prepare dielectric body 1. This process is nearly impossible to apply to a small dielectric body 1 because of the close distances between holes 2, 3, and 4.

Moreover, this process difficulty is enhanced when a larger diameter hole 3 is required to adjust the coupling between the resonators. This process is definitely disadvantageous for constructing miniature dielectric filters. Moreover, since two independent insulators 8 and 9 have be consistently provided, this increases the number of parts and the assembly difficulty.

SUMMARY OF THE INVENTION

The present invention solves such problems associated with conventional dielectric filters, and offers compact and high-performance dielectric filters.

The technical means of the invention to solve the above-described problems includes the provision of a single through-hole between the upper and lower surfaces of a pillar-shaped quarter wavelength resonator, the provision of electrodes covering the outer and lower surfaces of the dielectric body, and the provision of more than two independent electrodes on the internal surface of the through-hole to cover the spaces between the upper and lower surfaces within the through-hole.

BRIEF DESCRIPTION OF THE DRAWINGS

For a more complete understanding of the nature, features and advantages of the present invention, provided below is a detailed description of a few preferred illustrative embodiments of the invention, which are illustrated by and best understood with reference to the accompanying drawings wherein:

FIG. 1(*b*) shows a top view of a cross-section of the dielectric filter shown in FIG. 1 sectioned at the X—X′ line.

FIG. 2(*b*) shows a cross-section of the dielectric filter shown in FIG. 2(*a*) sectioned at the Y—Y′ line.

DESCRIPTION OF THE PREFERRED EMBODIMENTS

Figure 1A:
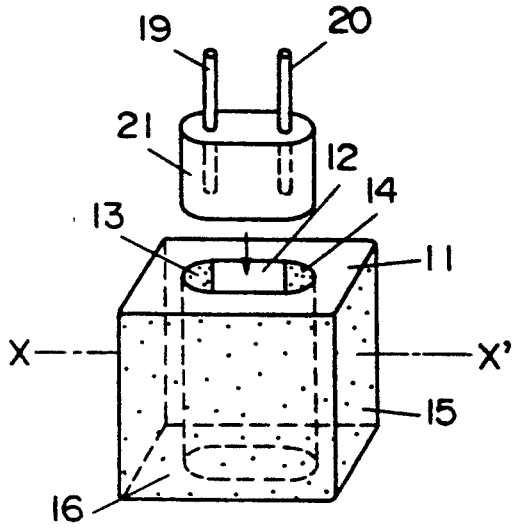
FIG. 1(*a*) shows a perspective view of an embodiment of a dielectric filter of the invention.
Figure 1B:
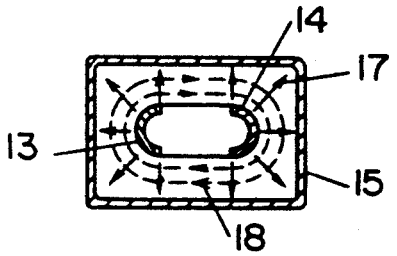

FIG. 1(*a*) shows a perspective view of a dielectric filter of the invention, and FIG. 1(*b*) shows a top view of the dielectric filter sectioned at the X—X′ line shown in FIG. 1(*a*), wherein a pillar-shaped quarter wavelength dielectric body 11 equipped with upper and lower surfaces made on the ceramic dielectric body or other material, is equipped with an oblong through-hole 12. Two independent internal electrodes 13 and 14 are provided also on an internal surface of through-hole 12, and these electrodes extend to the upper and lower surfaces of quarter wavelength dielectric body 11. Outer electrodes 15 and 16 are provided also on an outer surface and lower surface of quarter wavelength dielectric body 11.

Electrodes 13, 14, 15 and 16 can be formed by electroplating or metallizating processes. Since only respective ends of internal electrodes 13 and 14 are electrically connected to outer electrode 16 provided on the lower surface of dielectric body 11, two quarter wavelength resonators of which internal conductors are made of internal electrodes 13 and 14 are thus produced by this construction. For convenience, a resonator having internal conductor 13 as its internal conductor is named resonator A (shown on the left half of FIG. 1(*a*) and FIG. 1(*b*)), and a resonator having internal conductor 14 as its internal conductor is named resonator B (shown on the right half of FIG. 1(*a*) and FIG. 1(*b*).

Resonators A and B are magnetically coupled to each other as shown in FIG. 1(*b*) to constitute a double-stage dielectric filter. The dotted line and solid line in FIG. 1(*b*) show directions of the electric field and the magnetic field, respectively. The cross-section of hole 12 can be either one of circular, oblong, eyeglass-shaped, or cross-shaped hole, and the magnetic coupling between resonators A and B is variable according to the shape of hole 12. Since a single oblong hole is easier to form from the view point of press-molding of ceramics, an employment of this simplifies the associated problems and structures of a dielectric body.

By inserting an insulator 21 incorporating lead terminals 19 and 20 into hole 12 from the upper surface of dielectric body 11, lead terminals 19 and 20 are capacitively coupled to each of internal electrodes 13 and 14 through insulator 21, and connections to the external circuit become possible. The mechanical strength of insulator 21 is considerably higher than a conventional column shaped insulator. This is accomplished by insulator 21 taking a shape which is fitted into through-hole 12. Thus, a number of components can also be reduced.

Then, it is needless to say that any filter having multistage resonators can be constructed with a single hole by using the above-shown construction of a resonator. In addition to the above, no conventional holes are required to adjust the inter-stage coupling, and a better ceramic moldability is provided. This is particularly advantageous in the construction of miniaturized filters.

Figure 2A:
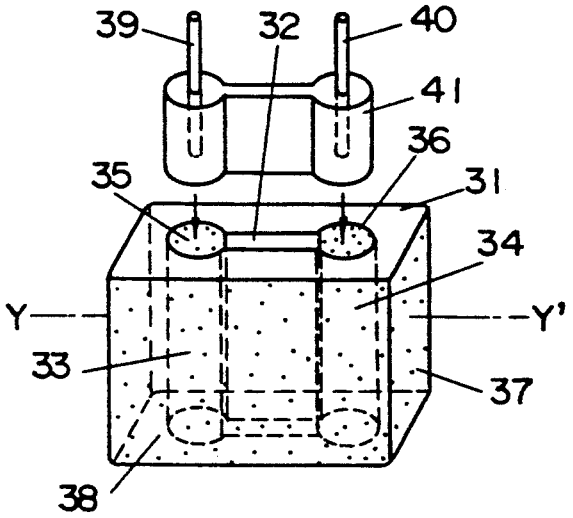
FIG. 2(*a*) shows a perspective view of a dielectric filter of another embodiment of the invention.
Figure 2B:
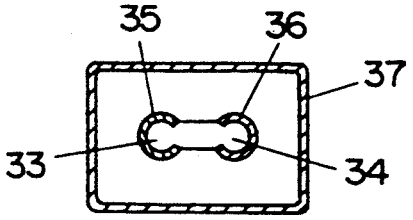

FIG. 2(*a*) shows another embodiment of a dielectric filter of the invention, and FIG. 2(*b*) shows a top view of the filter sectioned at the Y—Y' line shown in FIG. 2(*a*). An oblong through-hole 32 having two circular through-parts 33 and 34 is provided within a dielectric body 31 which is provided with upper and lower surfaces. Internal electrodes 35 and 36 extending toward an external surface and lower surface of dielectric body 31 are provided on the internal surfaces of circular through-parts 33 and 34 to constitute a double-stage dielectric filter such as the embodiment shown in FIGS. 1(*a*) and 1(*b*).

Furthermore, an insulator in which lead wires 39 and 40 are incorporated within and having an outer shape fitted into oblong through-hole 32 is inserted into through-hole 32 from the surface of dielectric body 31. The insulator is integrated within through-hole 32 to construct a dielectric filter.

A dielectric filter having such a construction has not only the features of the embodiment shown in FIGS. 1(*a*) and 1(*b*), but the Q of each resonator remains high because wider widths of internal electrodes 35 and 36 constituting internal conductors of resonators can be provided. Furthermore, a higher mechanical strength of the insulator can be secured because of its particular shape, and internal electrodes 35 and 36 provided onto column shaped parts 33 and 34 can be easily metallized by transfer printing using a round roller.

If a lower coupling between the resonators of a dielectric body of such construction is desired, this can be accomplished by providing a cross-shaped hole at a portion other than at internal electrodes 35 and 36 provided within through-hole 32. The resonator stages can also be increased easily by increasing the number of column shaped parts within through-hole 32 by a number of desired stages.

Figure 3:
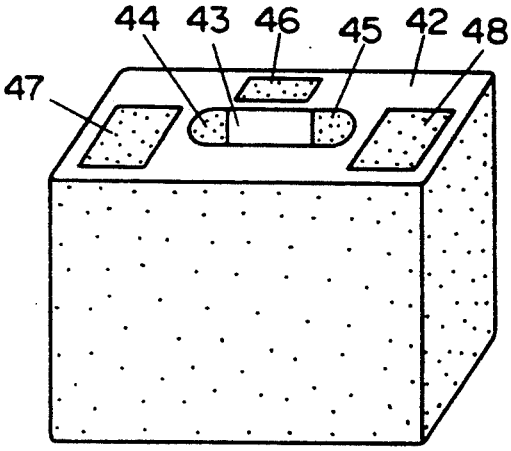
FIG. 3 show a perspective view of a dielectric filter of still another embodiment of the invention.
Figure 4:
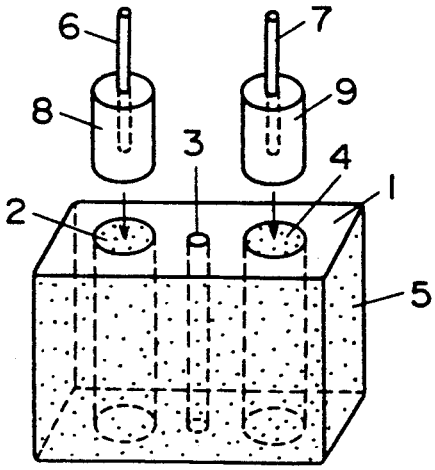
FIG.4 PRIOR ART
FIG. 4 show a perspective view of a conventional dielectric filter.

Still another embodiment of a dielectric filter of the invention is shown in FIG. 3 wherein a through-hole 43 is provided within a pillar-shaped dielectric body 42 having upper and lower surfaces, and two independent internal electrodes 44 and 45 are provided which extend to the upper and lower surface. Electrodes are provided also on an external surface and lower surface of dielectric body 42.

An inter-stage electrode 46 to alter the coupling between internal electrodes 44 and 45 is provided at a position between two internal electrodes 44 and 45. The coupling can be altered by the position and dimensions of inter-stage electrode 46. In addition to this, input and output electrodes 47 and 48 are provided on the upper surface of dielectric body 42. Input and output electrodes 47 and 48 are capacitively coupled to internal electrodes 44 and 45, respectively. However, input and output electrodes 47 and 48 do not capacitively interfere with each other.

According to the construction of a dielectric filter of the invention, a multistage filter can be realized by means of a simple molding process, and advantages shown in the following can be realized easily.

(1) A multistage filter of simple construction can be constructed by providing a single through-hole in a dielectric body.

(2) A molding process is simple because only a through-hole has to be provided, and the through-hole providing internal electrodes can be used as a hole to adjust the coupling between resonators.

(3) This filter construction is advantageous particularly to construct a filter on a miniaturized dielectric body.

(4) A higher mechanical strength can be secured because only one insulator incorporating lead terminals has to be used, and its outer shape is fitted to the through-hole provided in the dielectric body which is integrated with the through-hole.

What is claimed is:

1. A dielectric filter comprising:

a pillar-shaped quarter wavelength dielectric body with upper, lower and external surfaces, having a single through-hole with an internal surface between the upper and lower surfaces of said dielectric body;

a plurality of electrodes provided on the external and lower surface of said dielectric body; and a plurality of electrodes provided on the internal surface of said through-hole, wherein said electrodes extend to the upper and lower surfaces of said quarter wavelength dielectric body and are electrically connected to the electrode on the lower surface of the dielectric body, forming a plurality of resonators.

2. A dielectric filter according to claim 1 wherein said through-hole is provided with a plurality of circular through-parts.

3. A dielectric filter according to claims 1 or 2 wherein an insulator formed around a plurality of independent lead wires and having an external shape fitted to said through-hole is integrated within said through-hole.

4. A dielectric filter according to claims 1 or 2 wherein the electrodes on the internal surface are magnetically coupled to one another, and an electrode to adjust the magnetic coupling between said electrodes is disposed on the upper surface of the dielectric body.

5. A dielectric filter according to claims 1 or 2 wherein each of a plurality of further electrodes is capacitively coupled to a respectively different one of said plurality of electrodes with in said through-hole, wherein said further electrodes are provided on the upper surface of said quarter wavelength dielectric body.

* * * * *